United States Patent [19]

Hasker et al.

[11] 4,179,777

[45] Dec. 25, 1979

[54] METHOD OF PRODUCING A LOW-PRESSURE GAS DISCHARGE LAMP

[75] Inventors: Jan Hasker; Cornelis Peters, both of Eindhoven, Netherlands

[73] Assignee: U.S. Philips Corporation, New York, N.Y.

[21] Appl. No.: 765,935

[22] Filed: Feb. 7, 1977

[30] Foreign Application Priority Data

Mar. 30, 1976 [NL] Netherlands ..... 7603285

[51] Int. Cl.[2] ..... H01J 9/18

[52] U.S. Cl. ..... 29/25.13; 313/203

[58] Field of Search ..... 313/203; 29/25.13

[56] References Cited

U.S. PATENT DOCUMENTS

| | | | |
|---|---|---|---|
| 2,170,066 | 8/1939 | Ruben | 313/203 UX |
| 4,101,185 | 7/1978 | Hasker et al. | 316/19 |

*Primary Examiner*—Rudolph V. Rolinec
*Assistant Examiner*—Darwin R. Hostetter
*Attorney, Agent, or Firm*—Robert S. Smith

[57] ABSTRACT

A method of producing low-pressure gas discharge lamps wherein filamenting wool is prepared into a mat and then brought into the discharge space.

7 Claims, 4 Drawing Figures

METHOD OF PRODUCING A LOW-PRESSURE GAS DISCHARGE LAMP

The invention relates to a method of producing a low-pressure gas discharge lamp having a tubular discharge space in which two electrodes are disposed and wherein a body of thinly distributed filament wool, for example glass wool, is disposed between the electrodes.

From Dutch Patent Applications No. 7409366 which has been laid open to public inspection it is known to provide the discharge space of low-pressure gas discharge lamps, such as low-pressure mercury vapour discharge lamps and low-pressure sodium vapour discharge lamps with a body of thinly distributed filament wool, such as glass wool, for example quartz glass wool or gehlenite glass wool, wool of a ceramic material or metal wool provided with an insulating layer in order to increase the luminous flux per unit of volume.

One of the difficulties which are encountered in producing the above-mentioned discharge lamps is the application of the filament wool in the discharge space. The filament wool must namely be distributed very thinly over the entire discharge space.

French Pat. Specification No. 906,948 which also describes lamps whose discharge space is filled with glass wool discloses that the glass wool can be introduced into the discharge space by preshaping the glass wool, prior to introduction in the discharge space, into a lasting form of loose balls or wads. This method has the drawback that within the balls or wads the structure is not sufficiently thin while between the balls or wads large interspaces may be created in which there is no glasswool. This inhibits a uniform and stable built-up of the discharge.

A method of producing a low-pressure gas discharge lamp of the type according to the invention mentioned in the preamble is characterized in that, prior to introducing it into the discharge space, the filament wool is formed into a small mat having a length equal to or smaller than the distance between the electrodes, whereafter the mat is rolled to form a cylinder having a length equal to the length of the mat and introduced into the tubular discharge space.

By forming the filament wool into the form of a mat the degree of thinness of the wool in the lamp can be determined before the wool is introduced into the lamp. In addition, the wool is present thinly distributed over the entire discharge space after the mat has been rolled up and brought into the lamp.

In the mat it is possible, for example prior to rolling, to effect such a density distribution of the filament wool that after rolling and introducing into the lamp the density of the filament wool body near the longitudinal axis of the lamp deviates from the density near the wall, as described in Dutch Patent Application No. 7506654 which has been laid open to public inspection. In the mat the density, from the bottom to the top, may, for example, be varied such that after rolling the density of the wool near the longitudinal axis is greater than in the remaining part of the discharge space. The effect thereof is that the luminous flux of lamps provided with filament wool of such a distribution is higher than with a lamp with a uniform distribution of the filament wool.

The dimensions of the mat are so chosen that, after rolling, it can be placed in a simple manner in the lamp envelope. If the surface area of the cross-section of the mat is substantially equal to the surface area of the cross-section of the discharge tube a thin distribution of the wool over the entire discharge space is possible.

It is not necessary that the filamentwool mat is rolled into a cylinder in one step. It is also possible to create a cylinder having by rolling the mat several times until a cylinder is obtained having a length equal to the length of the mat.

Although it is possible to push or press the mat after rolling into the tubular discharge space it is advantageous to introduce the rolled-up mat supported by a gas stream into the discharge space. Then the degree of thinness is disturbed as little as possible.

The filament wool from which the mat is constructed is so thinly distributed that it is difficult to handle the mat. It is therefor advantageous to prepare the mat and to assemble it on a carrier prior to rolling and introducing into the lamp envelope. Thereafter the mat and support are rolled-up and introduced into the lamp. The material of the support is chosen such that the support, when in the discharge space, can be burnt out by means of a heat treatment.

Another possibility to place a mat in the tubular lamp envelope is to roll the mat in a thin, ductile material having a smooth surface and then to blow just the mat by means of a gas stream into the lamp envelope. In this way the mat can be introduced in a rapid manner into the lamp envelope without disturbing the thin distribution of the filament wool.

The mat may, as mentioned before, consist of glass wool, for example quartz glass wool or gehlenite glass wool or wool of a ceramic material. The mat may alternatively consist of metal wool, such as tungsten wool which is, for example, provided with an electrically insulating layer.

The mat need not of necessity consist of one whole. It is alternatively possible to introduce various mats in the rolled-up condition one after the other into the discharge space. Then a lamp is obtained in which the filament wool in the discharge space consists of several, for example detached, bodies.

The invention will now be further explained with reference to a drawing.

In the drawing FIG. 1 shows diagrammatically a tubular low-pressure mercury vapour discharge lamps produced with a method according to the invention.

Figure 1:
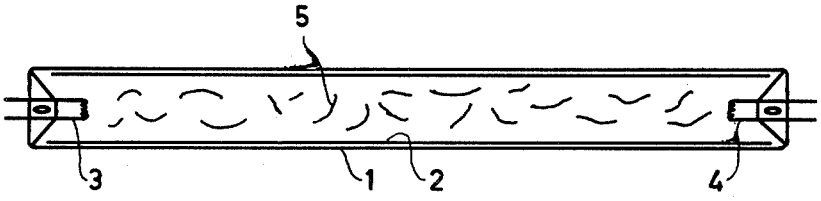

The lamp shown in FIG. 1 has a glass envelope 1 which is coated on the inside with a luminescent layer 2, which, for example, consists of manganese-and/or antimony-activated calcium halophosphate. The lamp is filled with mercury vapour and a rare gas or a combination of rare gasses. Thermally-emitting electrodes 3 and 4 are disposed at the respective ends of the discharge space. In the discharge space there is a body of glass wool 5 thinly distributed over substantially the entire discharge space.

Figure 2:
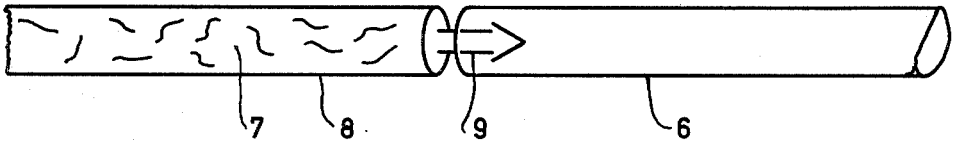
FIG. 2 shows an embodiment of a method according to the invention.

FIG. 2 shows an embodiment wherein the lamp envelope 6 is filled with glasswool 7 which is rolled-up and located in a cylinder 8 of thin, ductile material with a smooth surface, for example aluminium foil. The rolled-up mat is thereafter brought into the lamp envelope 6 from the cylinder 8 by means of a gas stream 9.

Figure 3:
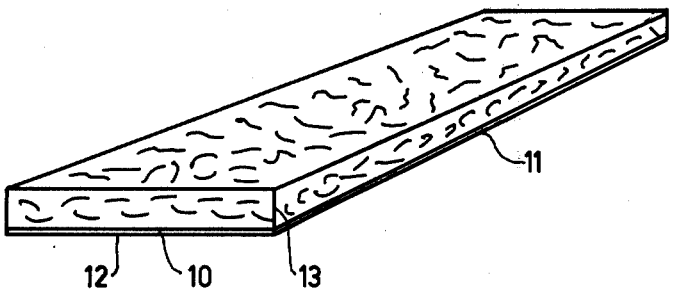
FIG. 3 shows a glasswool mat prior to rolling.

FIG. 3 shows a quartz glasswool mat in rolled-out condition. The mat is assembled on a support 10 which is approximately 0.1 mm thick. The support consists of a synthetic material, such as cellulose derivate or a polyester. Suitable materials are, for example, nitrocellulose, acrylates or methacrylates. Before the mat is applied on the support the glasswool from which the mat consists is fluffed by means of pins until a sufficiently thin structure is obtained. Optionally, the quartz glasswool can be fixed to the support by means of an adhesive. Thereafter the mat is rolled-up so that a cylinder of glass wool is obtained whose density near the longitudinal axis is greater than near the wall. The wall of the glass-wool cylinder then consists of the support. After the entire cylinder has been introduced into the lamp the support is removed by firing. With lamps provided with a luminescent layer this is, for example, done simultaneously with removing the temporary binder by means of which the luminescent layer is bonded to the glass wall of the lamp; in many cases this temporary binder consists of nitrocellulose. For lamps having a diameter of 2.5 cm and an electrode spacing of approximately 20 cm the mat has a length, which is indicated by 11, of approximately 20 cm. The width is indicated by 12 and then amounts to approximately 7.5 cm and the height 13 to about 1.2 cm. The mat has a weight of 15 mg. The glasswool filaments are 10 $\mu$m thick.

Figure 4:
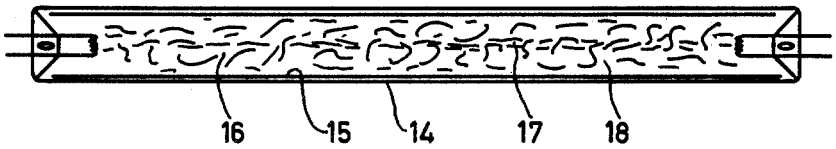
FIG. 4 shows a low-pressure mercury vapour discharge lamp in which the discharge space is provided with a rolled-up mat of glass wool, whose density near the longitudinal axis is greater than near the wall.

In FIG. 4 reference 14 indicates a low-pressure mercury vapour discharge lamp provided with a luminescent coating, for example consisting of manganese and/or antimony-activated calcium halophosphate. The luminescent coating is indicated by 15. A mat as described in FIG. 3 is applied in the lamp in the rolled-up condition and shown by 16. The density of the glasswool near the longitudinal axis 17 is then greater than near the wall 18. A lamp, the indispensible ballast included, provided with such a rolled-up mat has at a pressure of 4 torr of a mixture of 30% helium and 70% neon and a power of 20 Watt an output of 41 lumen per Watt when operated from a 220 volts mains voltage.

What is claimed is:

1. A method for producing a low-pressure gas discharge lamp having two electrodes which comprises: providing an elongated envelope; providing a quantity of thinly distributed filament wool; then preparing said filament wool into a mat having a length equal to or smaller than the distance between the electrodes; then rolling said mat to form a generally cylindrical member having an outer diameter substantially equal to the inner diameter of said envelope and a length substantially equal to the length of the mat; and then introducing said member into the elongated envelope to provide a substantially uniform distribution of said wool within essentially all of said envelope; said introducing step including the use of a gas stream.

2. A method as claimed in claim 1 wherein said preparing step includes rolling said mat about a thin ductile support with a smooth surface and said introducing step includes blowing just said mat off said support by means of a gas stream into said lamp envelope.

3. A method for producing a low-pressure gas discharge lamp having two electrodes which comprises: providing an elongated envelope; providing a quantity of thinly distributed filament wool; then preparing said filament wool into a mat having a length equal to or smaller than the distance between the electrodes; then rolling said mat to form a generally cylindrical member having an outer diameter substantially equal to the inner diameter of said envelope and a length substantially equal to the length of the mat; and then introducing said member into the elongated envelope to provide substantially uniform distribution of said wool within essentially all of said envelope; wherein said preparing step includes positioning said mat on a support which consists of material which can be removed by means of a heat treatment, said introducing step including introducing said support and mat into said envelope and said method includes a step after said introducing step of heating said support to remove said support.

4. A method as claimed in claim 3 wherein said support consists of nitrocellulose.

5. A method as claimed in claim 4 wherein said support consists of a methacrylate.

6. A method for producing a low-pressure gas discharge lamp having two electrodes which comprises: providing an elongated envelope; providing a quantity of thinly distributed filament wool; then preparing said filament wool into a mat having a length equal to or smaller than the distance between the electrodes; then rolling said mat to form a generally cylindrical member having an outer diameter substantially equal to the inner diameter of said envelope and a length substantially equal to the length of the mat and a distribution having a density near the longitudinal axis thereof greater than near the circumference thereof; and then introducing said member into the elongated envelope to provide a substantially uniform distribution of said wool within essentially all of said envelope; said introducing step including the use of a gas stream.

7. A method as described in claim 6 further including the steps of forming a second rolled up mat and introducing said second rolled up mat into the elongated envelope.

* * * * *